US011359463B2

(12) United States Patent
Souza et al.

(10) Patent No.: US 11,359,463 B2
(45) Date of Patent: Jun. 14, 2022

(54) OFFSHORE PRODUCTION SYSTEMS WITH TOP TENSIONED TENDONS FOR SUPPORTING ELECTRICAL POWER TRANSMISSION

(71) Applicant: HORTON DO BRASIL TECNOLOGIA OFFSHORE, LTDA., Rio de Janeiro (BR)

(72) Inventors: Marcelo I. L. Souza, Rio de Janeiro (BR); Xavier Castello, Rio Grande (BR); Rodrigo M. R. Guimarães, Rio de Janeiro (BR); Luiz Germano Bodanese, Rio de Janeiro (BR); Rafael Bodanese, Macaé (BR)

(73) Assignee: HORTON DO BRASIL TECNOLOGIA OFFSHORE LTDA., Rio de Janeiro (BR)

( * ) Notice: Subject to any disclaimer, the term of this patent is extended or adjusted under 35 U.S.C. 154(b) by 108 days.

(21) Appl. No.: 16/625,249

(22) PCT Filed: Jun. 21, 2018

(86) PCT No.: PCT/BR2018/050203
§ 371 (c)(1),
(2) Date: Dec. 20, 2019

(87) PCT Pub. No.: WO2018/232483
PCT Pub. Date: Dec. 27, 2018

(65) Prior Publication Data

US 2020/0149373 A1 May 14, 2020

Related U.S. Application Data

(60) Provisional application No. 62/523,111, filed on Jun. 21, 2017.

(51) Int. Cl.
*E21B 7/128* (2006.01)
*E21B 17/01* (2006.01)
(Continued)

(52) U.S. Cl.
CPC ..... *E21B 43/0107* (2013.01); *E21B 7/128* (2013.01); *E21B 17/01* (2013.01); *H01B 7/046* (2013.01)

(58) Field of Classification Search
None
See application file for complete search history.

(56) References Cited

U.S. PATENT DOCUMENTS 3,517,110 A 6/1970 Morgan
3,813,477 A 5/1974 Fischer
(Continued)

FOREIGN PATENT DOCUMENTS

CN 203787177 U 8/2014
WO 2006/130758 A1 12/2006
WO 2017/065961 A1 4/2017

OTHER PUBLICATIONS

PCT/BR2018/050203 International Search Report and Written Opinion dated Feb. 15, 2019 (20 p.).
(Continued)

*Primary Examiner* — Matthew Troutman
*Assistant Examiner* — Douglas S Wood
(74) *Attorney, Agent, or Firm* — Conley Rose, P.C.

(57) ABSTRACT

An offshore production system includes a surface vessel, a tubular tendon extending between the surface vessel and a lower connection system disposed at a seabed, the riser coupled to the surface vessel with an upper connection system, and an electrical cable extending through a central
(Continued)

passage of the tubular tendon, wherein the upper connection system comprises a connector that physically supports the electrical cable.

20 Claims, 8 Drawing Sheets

(51) Int. Cl.
*E21B 43/01* (2006.01)
*H01B 7/04* (2006.01)

(56) References Cited

U.S. PATENT DOCUMENTS 3,934,647 A * 1/1976 Bokenkamp ..... E21B 43/013 166/347
4,462,717 A 7/1984 Falcimaigne
4,523,877 A * 6/1985 Finn ..... F16L 1/19 405/195.1
6,695,542 B2 2/2004 Stromberg et al.
8,128,129 B2 3/2012 Gutierrez-Lemini et al.
8,807,225 B2 8/2014 Varkey et al.
2004/0081865 A1 4/2004 Zhang et al.
2004/0141812 A1 7/2004 Busso
2010/0038899 A1* 2/2010 Clover ..... F16L 1/26 285/120.1
2010/0059230 A1 3/2010 Skeels
2011/0132615 A1* 6/2011 Gonzalez ..... E21B 33/035 166/366
2014/0138046 A1 5/2014 Moore
2015/0041171 A1* 2/2015 Heggdal ..... G02B 6/442 174/15.6

OTHER PUBLICATIONS

PCT/BR2018/050203 Article 19 Amendments filed Apr. 12, 2019 (12 p.).
European Search Report dated May 11, 2021, for European Application No. 18820697.3 (7 p.).

* cited by examiner

OFFSHORE PRODUCTION SYSTEMS WITH TOP TENSIONED TENDONS FOR SUPPORTING ELECTRICAL POWER TRANSMISSION

CROSS-REFERENCE TO RELATED APPLICATIONS

This application is a 35 U.S.C. § 371 national stage application of PCT/BR2018/050203 filed Jun. 21, 2018 and entitled "Offshore Production Systems with Top Tensioned Tendons for Supporting Electrical Power Transmission," which claims priority to and the benefit of U.S. provisional patent application Ser. No. 62/523,111, filed Jun. 21, 2017, and entitled, "Offshore Production Systems with Top Tensioned Tendons for Supporting Electrical Power Transmission," the contents of which are incorporated herein by reference in their entirety for all purposes.

STATEMENT REGARDING FEDERALLY SPONSORED RESEARCH OR DEVELOPMENT

Not applicable.

BACKGROUND

Field of the Disclosure

The disclosure relates generally to offshore production systems. More particularly, the disclosure relates to offshore production systems comprising marine risers configured for the transmission of electrical power between a surface structure of the production system and a location near or at the seabed.

Background to the Disclosure

In offshore production operations, natural gas produced from a subsea well may be transported to a vessel (e.g., LNG vessel) for temporary storage, and then periodically offloaded to a shuttle gas vessel (e.g., LNG carrier) for transport to shore. The use of a large number of vessels and the potential need for frequent offloading may result in high costs for these operations. In addition, this approach typically includes the compression of the natural gas and conversion of the natural gas to liquid natural gas (LNG) to enhance its density prior to transport. Alternatively, the natural gas may be transported to shore via a pipeline. However, this approach assumes the pipeline infrastructure is in place, which may not be the case in immature and/or remote fields.

SUMMARY

An embodiment of an offshore production system comprises a surface vessel, a tubular tendon extending between the surface vessel and a lower connection system disposed at a seabed, the riser coupled to the surface vessel with an upper connection system, and an electrical cable extending through a central passage of the tubular tendon, wherein the upper connection system comprises a connector that physically supports the electrical cable. In some embodiments, the surface vessel comprises a floating platform. In some embodiments, the tubular tendon comprises a top-tension riser. In certain embodiments, the connector comprises an armor pot connector. In certain embodiments, the offshore production system comprises a cooling system that includes a pump configured to pump fluid through the central passage of the tubular tendon to cool the electrical cable. In some embodiments, the pump is positioned on the surface vessel. In some embodiments, the pump is positioned subsea. In certain embodiments, the offshore production system comprises a cooling system that includes a cooling joint disposed subsea and coupled to the tendon, wherein the cooling joint comprises a first port configured to allow sea water to enter a passage of the cooling joint and a second port spaced from the first port configured to vent sea water from the passage and cool the electrical cable through natural convection.

An embodiment of an offshore production system comprises a surface vessel, a tendon extending between the surface vessel and a base disposed at a seabed, an electrical cable extending between the surface vessel and the base, a hub spaced from the base and coupled to the tendon and the electrical cable, and a J-tube coupled to the base, wherein the electrical cable extends through the J-tube. In some embodiments, the offshore production system comprises a plurality of electrical cables circumferentially spaced about the tendon, wherein each electrical cable is coupled to the guide and extends through a J-tube coupled to the base. In some embodiments, the offshore production system comprises a hydrocarbon conduit extending to the surface vessel, and a power plant disposed on the surface vessel, wherein the power plant is configured to convert chemical energy provided by hydrocarbons supplied by the hydrocarbon conduit into electrical energy transportable by the electrical cable. In certain embodiments, the offshore production system comprises a bell-mouth coupled to an end of the J-tube. In certain embodiments, the hub comprises a cooling joint that includes a first port configured to allow sea water to enter a passage of the cooling joint and a second port spaced from the first port configured to vent sea water from the passage and cool at least one of the electrical cables through natural convection. In certain embodiments, the offshore production system comprises a pump configured to pump sea water through the passage of the cooling joint to cool at least one of the electrical cables through forced convection.

An embodiment of an offshore production system comprises a surface vessel, a tubular tendon extending between the surface vessel and a lower connection system disposed at the seabed, the riser coupled to the surface vessel with an upper connection system, and an electrical cable extending through a central passage of the tubular tendon. The upper connection system comprises a connector housing that received the electrical cable therethrough, and the connector housing is filled with a potting material that is configured to transfer loads between the electrical cable and the housing. In some embodiments, the potting material comprises a resin that is configured to form a resin matrix. In some embodiments, the upper connection system further comprises a top tensioner including a plurality of tensioner links coupled to the tubular tendon and the surface vessel, wherein each tensioner link includes a tensioner that is configured to controllably adjust a tension in in the tensioner link. In some embodiments, the offshore production system further comprises a cooling system including a cooling passage extending helically about the electrical cable within the housing, wherein the cooling system further includes a pump configured to flow a cooling fluid through the cooling passage. In some embodiments, the lower connection system includes a foundation extending into the seabed, wherein the foundation is coupled to a lower end of the tubular tendon, a J-tube coupled to and extending from the tubular tendon, and a bell-mouth coupled to an end of the J-tube, wherein the electrical cable extends from the tubular tendon and through the J-tube. In some embodiments, the lower end of the tubular tendon is coupled to the foundation with a flex joint that is configured to allow relative angular movement between the foundation and the tubular tendon. In some embodiments, the lower end of the tubular tendon is coupled to the foundation with a stress joint that is configured to provide a variable stiffness between the foundation and the tubular tendon.

BRIEF DESCRIPTION OF THE DRAWINGS

For a detailed description of the disclosed exemplary embodiments, reference will now be made to the accompanying drawings, wherein.

DETAILED DESCRIPTION

Figure 1:
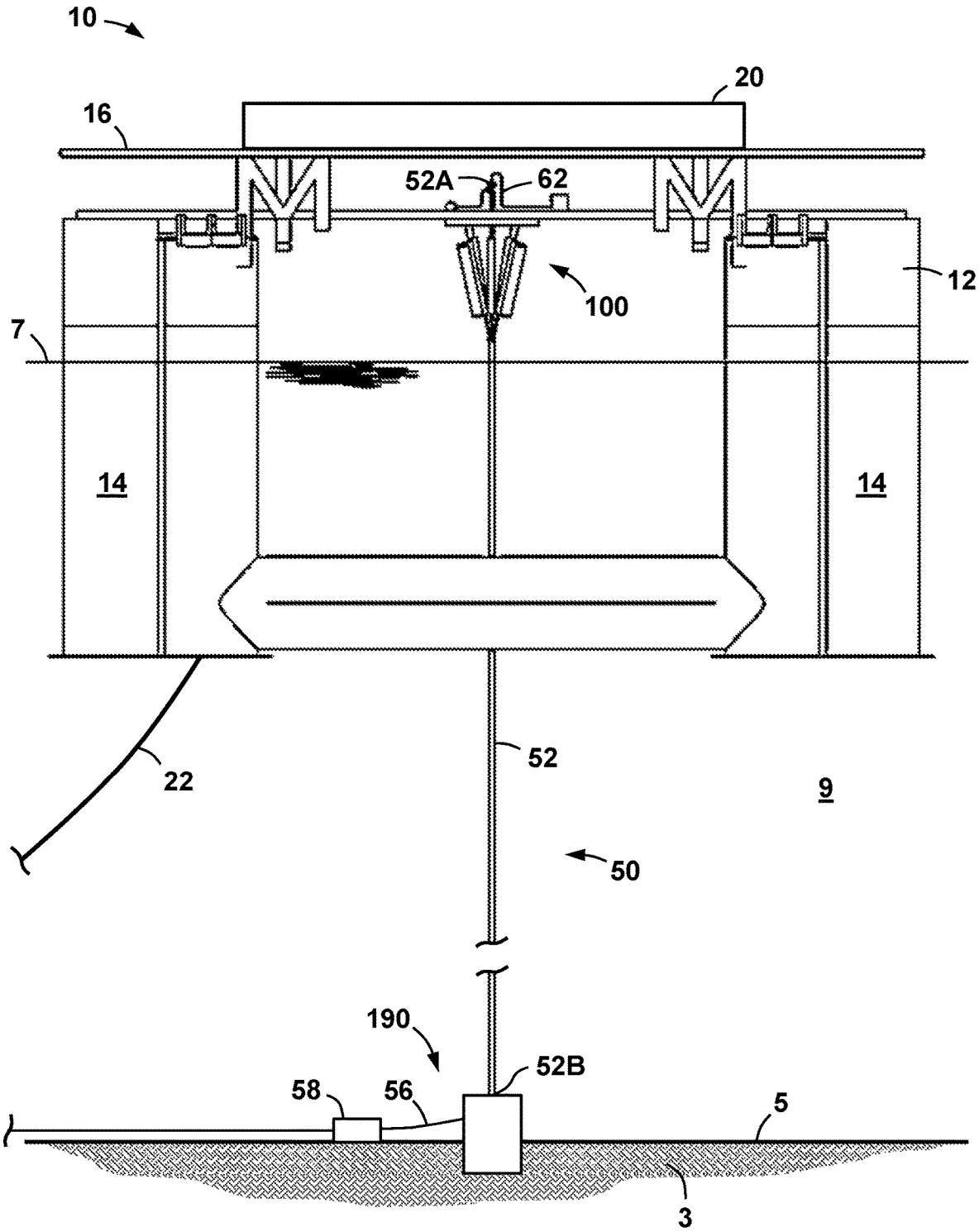
FIG. 1 is a schematic view of an embodiment of an offshore production system in accordance with principles disclosed herein.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis.

As previously described, natural gas produced offshore may be transported to shore via surface vessels and/or pipeline. However, as previously described, both of these approaches present potential obstacles. Another option is to convert the gas into electricity at an offshore platform, and then transmit the electrical power from the platform to subsea high voltage direct current (HVDC) power cables, which in turn transport the electrical power to shore. This approach eliminates the need to transport the natural gas to shore. To transport the relatively large amounts of electrical power generated from the natural gas (e.g., 1 GW), the HVDC power cables are made of a thick aluminum or copper core shielded by a layer of lead. However, the layer of lead has a relatively low fatigue life, and thus, may not be suitable for use in dynamic applications (e.g., to transport electrical power from the platform to the seabed). In addition, HVDC power cables can generate relatively large amounts of thermal energy. At the seabed, the relatively cold water surrounding the HVDC power cables may provide sufficient cooling. However, portions of the HVDC power cables at or proximal the sea surface and the platform topside may be exposed to solar radiation, air, or relatively warm water. Sufficient heating of the HVDC power cables may result in limiting of the maximum power transmittable by the cables in order to prevent damage to the materials involved. For instance, due to the Joule Effect, excessive heating of the power cables may weaken the mechanical properties of the materials comprising the power cables.

Accordingly, embodiments described herein are directed to production systems for producing natural gas to an offshore structure, converting the natural gas to electrical power, and transporting the electrical power from the offshore structure to power cables disposed on the seabed. As will be described in more detail below, embodiments described herein offer the potential to reduce fatigue of the power cables and reduce thermal expansion of the power cables.

Referring now to FIG. 1, an embodiment of an offshore production system 10 is shown. System 10 generates electrical power from natural gas produced from a subterranean formation 3 disposed beneath a seabed 5, and transports the electrical power to the seabed 5 for transmission to another location (e.g., the shore). In the embodiment of FIG. 1, production system 10 generally includes an offshore structure or platform 12 disposed at a surface or waterline 7 of the sea 9 and a cable support assembly 50 extending substantially vertically from platform 12 to the seabed 5. Assembly 50 includes a tubular pipe or conduit 52, a first or upper connection system 100, and a second or lower connection system 190. Conduit 52 has a first or upper end 52A connected to vessel 12 with upper connection system 100 and a second or lower end 52B connected to seabed 5 with lower connection system 190. As will be described in more detail below, conduit 52 is placed in tension between connection systems 100, 190, and more specifically, comprises a top tensioned riser (TTR). Thus, conduit 52 may also be referred to herein as a tendon or top tensioned riser.

Figure 2:
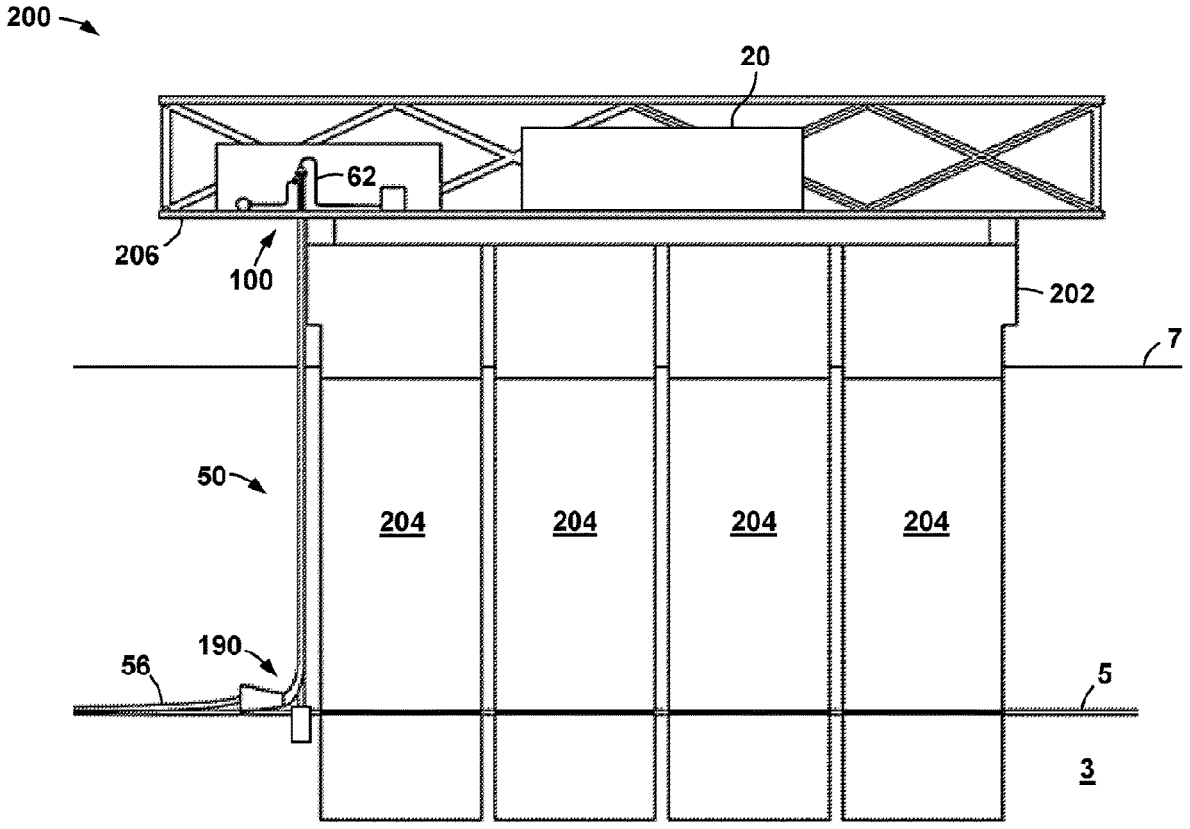
FIG. 2 is a schematic view of another embodiment of an offshore production system in accordance with principles disclosed herein.

As shown in FIG. 1, platform 12 is a floating structure, and in particular, a semi-submersible platform including a ballast adjustable, buoyant hull 14 that supports deck or topsides 16 above the waterline 7. Although offshore platform 12 is a floating semi-submersible platform in this embodiment, in other embodiments, the offshore structure (e.g., platform 12) may comprise a drillship, tension-leg platform, a spar platform, or other types of known floating offshore structures. In still other embodiments, the offshore structure may comprise a bottom-founded structure directly supported by the seabed 5. For example, FIG. 2 illustrates an embodiment of an offshore production system 200 including a bottom founded offshore structure 202 and a cable support assembly 50 extending from structure 202 to the seabed 5. In the embodiment shown in FIG. 2, assembly 50 is the same as assembly 50 previously described and shown in FIG. 1, however, offshore structure 202 is a bottom-founded platform that is physically supported by the seabed 5. In particular, offshore structure 202 includes a plurality of support members or columns 204 extending from the seabed 5 and supporting a deck or topsides 206 above the waterline 7.

Referring again to FIG. 1, deck 16 of platform 12 supports a processing or power plant 20 for converting natural gas produced from subterranean formation 3 into electrical power or energy. In the embodiment of FIG. 1, the natural gas is transported to power plant 20 via a conduit or riser 22. In this embodiment, riser 22 transports natural gas to power plant 20 from a subsea production manifold (not shown) disposed on the seabed 5; however, in other embodiments, riser 22 may transport natural gas from other offshore structures, including subsea production wells that extend into subterranean formation 3, and other offshore platforms disposed at the waterline 7.

Figure 3:
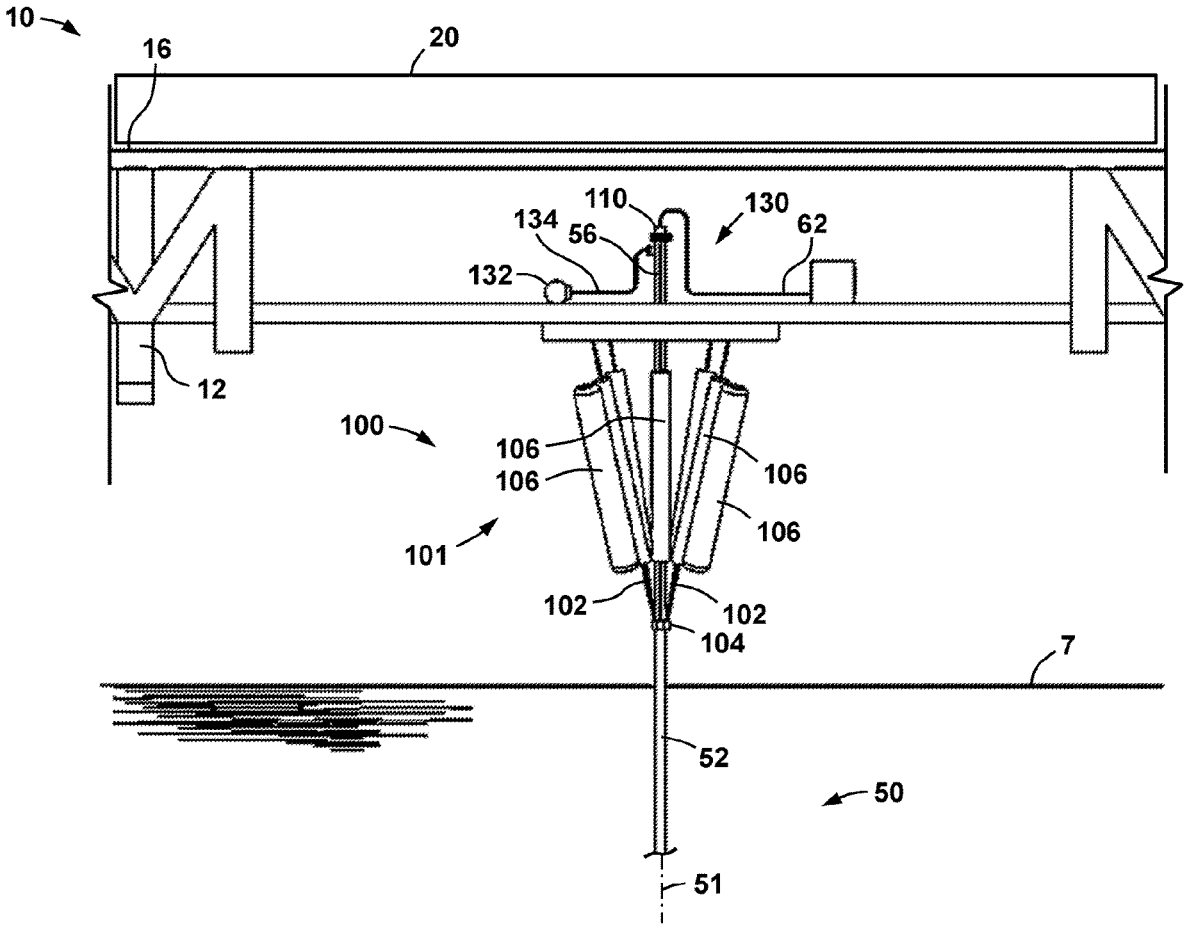
FIG. 3 is an enlarged schematic view of the upper connection system of FIG. 1.
Figure 4:
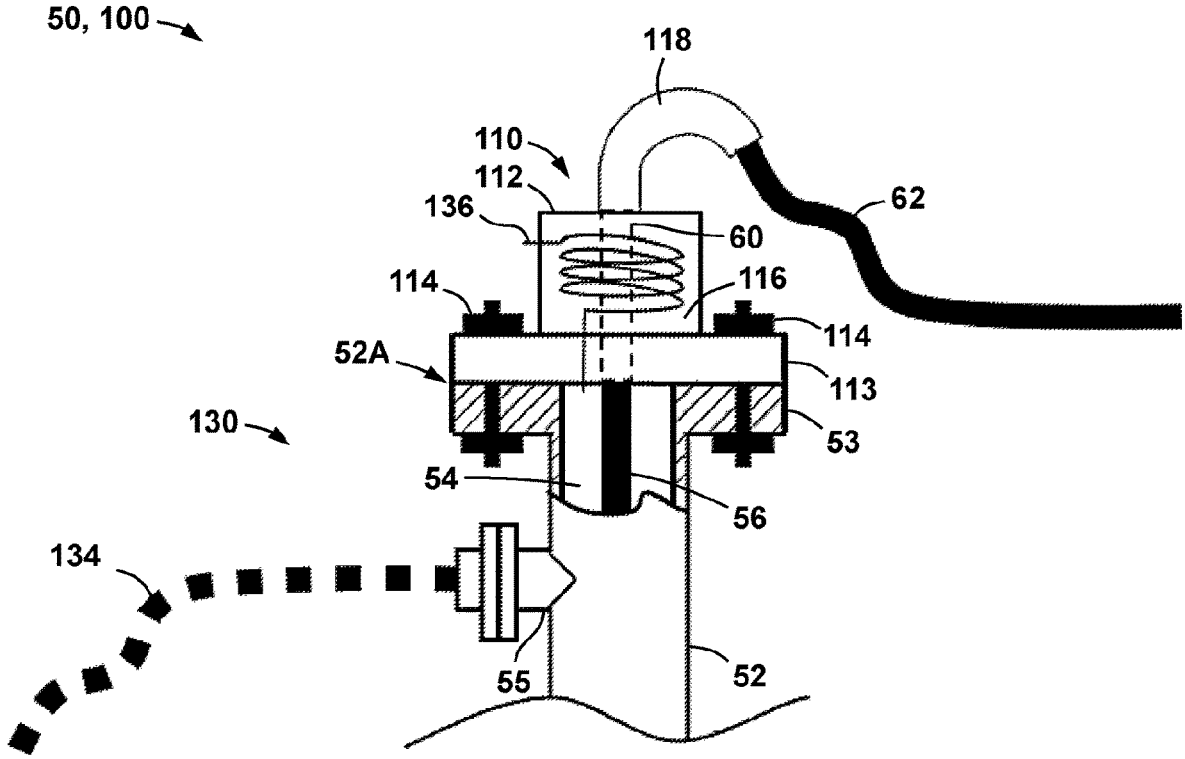
FIG. 4 is an enlarged schematic view of the upper end of the tendon of FIG. 1.
Figure 5:
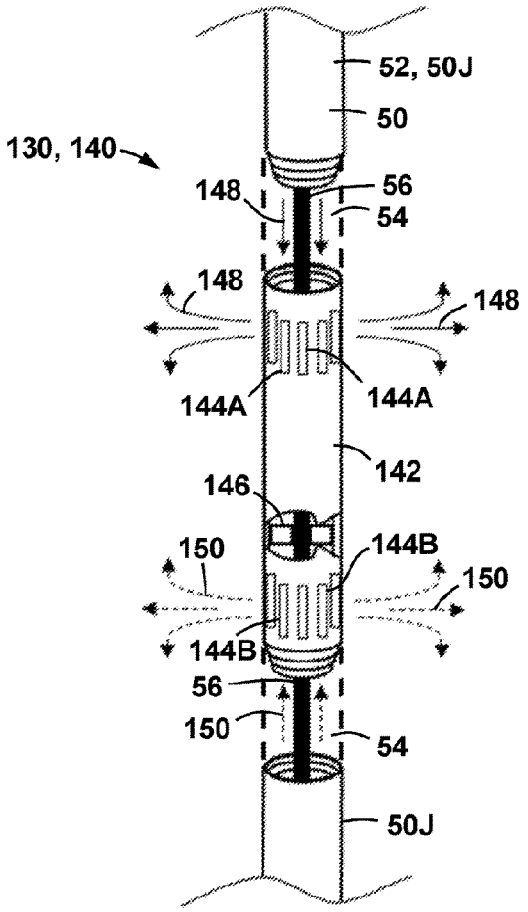
FIG. 5 is a partial schematic side view of the cooling system of FIG. 3.

Referring to FIGS. 1, 3, and 4, cable support assembly 50 provides for the communication of electrical energy or power produced by power plant 20 to a location at, or proximal to, the seabed 5. In the embodiment of FIGS. 1, 3, and 4, tendon 52 includes a central bore or passage 54 through which a first electrical cable 56 extends. Cable 56 extends between ends 52A, 52B of tendon 52. The lower end of cable 56 is coupled to a subsea electrical connector 58 disposed in the seabed 5. As will be discussed further herein, the upper end of cable 56 couples to the upper end 52A of tendon 52, and is electrically connected to a second electrical cable 62 that extends to the power plant 20. Electrical cable 56 includes an inner electrical conductor (or core) that is shielded by or sheathed in an outer electrical insulator. In this embodiment, the inner conductor of cable 56 comprises an aluminum or copper material while the surrounding insulator comprises lead based material. In some embodiments, the surrounding insulator comprises a lead alloy, such as a lead-tin alloy. As previously described, lead insulators have a relatively low fatigue life.

By converting the chemical energy of the natural gas transported to structure 12 via riser 22 into electrical energy transportable via electrical cables 56 and 62, compression of the natural gas at platform 12 (e.g., for transport to an onshore facility via vessels) may be eliminated, increasing the efficiency and economic viability of production system 10. Additionally, transporting energy and power via electrical cables 56 and 62 eliminates the need to transport natural gas via pipelines, thereby mitigating the risk of hydrocarbon leakage into the surrounding environment.

Referring now to FIGS. 3 and 4, in this embodiment, the upper connection system 100 of assembly 50 includes a top tensioner 101, a connector assembly 110, and a cooling system 130. Top tensioner 101 includes a plurality of tensioner links 102 uniformly circumferentially-spaced about tendon 52 (or about an axis 51 of tendon 52). In some embodiments, each tensioner link 102 comprises a steel rod extending from a piston of a corresponding hydro-pneumatic cylinder of the top tensioner 101. Links 102 have upper ends fixably attached to a lower deck 18 of topsides 16 and lower ends fixably attached to tendon 52 with a tensioner ring 104 disposed about tendon 52 proximal upper end 52A. A tensioner 106 is disposed along each link 102 to controllably adjust the tension in the corresponding link 102. Tensioner assembly 101 physically supports tendon 52 by applying tension to the upper end 52A of tendon 52 via links 102. Tensioners 106 control the amount of tension applied to each link 102, and hence, control the tension applied to tendon 52.

Connector assembly 110 couples the upper portion of electrical cable 56 to the upper end 52A of the tendon 52 and transmits dynamic loads from electrical cable 56 to the tendon 52. Particularly, during offshore operations, platform 12 may experience heave (vertical movement) relative to components of cable support assembly 50, thereby applying dynamic loads to the components of cable support assembly 50. As described above, in some embodiments, electrical cable 56 may be insulated by materials having a relatively low fatigue life (e.g., lead), and thus, it may be advantageous to isolate electrical cable 56 from the dynamic loads applied to cable support assembly 50. Accordingly, as will be described in more detail below, in this embodiment, connector assembly 110 isolates and shields electrical cable 56 from dynamic loads applied to cable support assembly 50, thereby offering the potential to increase the operating lifetime of cable 56.

In this embodiment and as shown in FIG. 4, connector assembly 110 includes an armor pot connector comprising a connector housing 112, a plurality of fasteners 114, a support or potting material 116, and a cable guide or bend restrictor 118. Connector housing 112 is generally cylindrical and includes a connector flange 113 that matingly engages a corresponding connector flange 53 formed at the upper end 52A of tendon 52. Fasteners 114 extend through flanges 113 and 53 to releasably attach housing assembly 110 to the upper end 52A of tendon 52. In this embodiment, fasteners 114 are bolts.

The potting material 116 of connector assembly 110 physically supports electrical cable 56 and couples cable 56 to connector housing 112, thereby allowing dynamic loads applied to cable 56 to be transmitted to connector housing 112 via material 116. Potting material 116 fills the annulus between cable 56 and connector housing 112. Thus, potting material 116 contacts or physically engages both electrical cable 56 and connector housing 112. In this embodiment, potting material 116 comprises a casting or potting resin material that forms a resin matrix; however, in other embodiments, potting material 116 may comprise a variety of materials for coupling cable 56 with connector housing 112. In still other embodiments, connector assembly 110 may comprise another type of connector than an armor pot connector, and thus, may utilize another structure for transmitting loads between cable 56 and connector housing 112 than a support or potting material disposed within housing 112.

Additionally, in this embodiment, connector assembly 110 includes an electrical connection or connector 60 disposed at least partially in connector housing 112. Particularly, at least a portion of electrical connector 60 is coupled to an upper end of electrical cable 56, forming a termination of electrical cable 56. Further, at least a portion of electrical connector 60 is coupled to an end of the second electrical cable 62 that extends through the bend restrictor 118 of connector assembly 110, forming a termination of electrical cable 62. In this arrangement, electrical connector 60 provides an electrical connection between electrical cables 56 and 62, allowing for the transmission of electrical energy and power therebetween. In some embodiments, both cables 56 and 62 comprise HVDC power cables. Given that electrical cable 62 is not protected by tendon 52, it may be subject to greater dynamic loads, requiring the use of materials having relatively greater resistance to fatigue damage. However, given that cable 62 is not exposed to sea water 9 below the waterline 7, it may not require the hydraulic insulation as with electrical cable 56, and thus, may not comprise insulating materials, such as lead based materials, that are relatively more susceptible to fatigue damage.

Bend restrictor 118 extends from an upper end of connector housing 112 and prevents the portion of electrical cable 62 extending from connector housing 112 from bending or kinking to an extent that could damage electrical cable 62. Bend restrictor 118 limits the bend radius of this portion of electrical cable 62 by maintaining a minimum bend radius that prevents damage to electrical cable 62, where the minimum bend radius may vary depending upon the geometry and materials comprising cable 62. In this embodiment, bend restrictor 118 is made of a series of articulated joints that allows limited bending of electrical cable 62 while preventing cable 62 from bending to an extent that could damage cable 62; however, in other embodiments, bend restrictor 118 may be made of polymeric or metallic materials, such that temperature and other operational parameters are satisfied.

Referring still to FIGS. 3 and 4, cooling system 130 of upper connection system 100 functions as a heat exchanger to transfer thermal energy away from electrical cable 56. Particularly, cooling system 110 cools the portion of electrical cable 56 extending between the waterline 7 and the upper end 52A of tendon 52, which may not be exposed to the sea 9, and thus, cannot rely on the surrounding sea 9 as a heat sink for absorbing thermal energy. In this embodiment, cooling system 130 generally includes a surface pump 132, a cooling fluid conduit or hose 134 extending from pump 132 to tendon 52, and a cooling passage 136.

Surface pump 132 of cooling system 130 pumps sea water 9 from a supply conduit (not shown) into the passage 54 of tendon 52 via hose 134 and a port 55 disposed along tendon 52 proximal or adjacent upper end 52A. In this manner, surface pump 132 may pump sea water into passage 54, which is then circulated downward through passage 54 towards the lower end 52B of tendon 52. Sea water pumped into passage 54 of tendon 52 also circulates through passage 136, which extends through connector housing 112 and winds helically about cable 56, and may subsequently be ejected to the surrounding environment or recirculated to surface pump 132. In some embodiments, passage 136 may comprise a fluid channel formed directly in the potting material 116 of connector assembly 110, while in other embodiments passage 136 may comprise a coil formed from a metallic material.

In this arrangement, thermal energy is transferred from electrical cable to the sea water pumped into passage 54 via surface pump 132. Particularly, sea water 9 pumped through passage 54 cools the portion of electrical cable 56 extending from the waterline 7 to the upper end of connector housing 112. Moreover, the cooling of electrical cable 56 provided by cooling system 130 may increase the longevity of electrical cable 56 and increase the resilience of cable 56 during operation of production system 10 by maintaining the portion of cable 56 cooled by cooling system 130 at a reduced temperature relative to what cable 56 would operate at without the cooling provided by system 130.

Referring now to FIGS. 1 and 3-5, cooling system 130 may also include components disposed subsea or beneath waterline 7 to further assist in cooling electrical cable 56. In the embodiment of FIGS. 1 and 3-5, cooling system 130 includes a subsea cooling assembly 140 comprising a plurality of tubular cooling joints 142 disposed along tendon 52 of production system 10. Particularly, tendon 52 comprises a plurality of joints 52J and one or more cooling joints 142 coupled to joints 52J.

Cooling joints 142 facilitate the flow of sea water 9 through passage 54 of tendon 52 to thereby cool electrical cable 56. In particular, each cooling joint 142 is positioned below the waterline 7 and includes a first or upper plurality of circumferentially spaced ports or vents 144A and a second or lower plurality of circumferentially spaced ports or vents 144B. Upper ports 144A are positioned proximal a first or upper end of cooling joint 142 while lower ports 144B are positioned proximal a second or lower end of cooling joint 142. Additionally, cooling joint 142 includes an annular collar or seal assembly 146 axially positioned between ports 144A, 144B within. Collar 146 is disposed within central passage 54 and extends radially between electrical cable 56 and cooling joint 142. Thus, in this arrangement, collar 146 prevents direct fluid flow through passage 54 between the upper and lower ends of cooling joint 142. As a result, a first or downward fluid flowpath 148 and a second or upward fluid flowpath 150 are formed in passage 54 of tendon 52.

Downward fluid flowpath 148 extends between the upper end 52A of tendon 52 and upper ports 144A of the cooling joint 142 positioned beneath waterline 7. Particularly, surface pump 132 of cooling system 130 pumps sea water 9 into passage 54 of tendon 52 at upper end 52A via port 55, and from upper end 52A, pumps sea water 9 through passage 54 along downward fluid flowpath 148. The sea water 9 pumped by surface pump 132 is blocked from flowing further downwards through passage 54 by collar 146, and thus, is ejected from passage 54 into the sea disposed beneath waterline 7 via upper ports 144A. In addition, sea water flows upwards through passage 54 along upward fluid flowpath 150, and, due to collar 146, is forced back into the sea below waterline 7 via lower ports 144B. In this embodiment, sea water flowing along upward fluid flowpath 150 enters passage 54 at the lower end 52B of tendon 52; however, in other embodiments, sea water flowing along flowpath 150 may enter passage 54 via another cooling joint 142 positioned below the joint 142 shown in FIG. 5. Sea water flows upwards along flowpath 150 in response to heat transfer between electrical cable 56 and sea water. Particularly, once sea water 9 enters passage 54 it is heated by electrical cable 56, causing the sea water 9 to flow upwards along upward fluid flowpath 150 due (at least in part) to the phenomenon of natural convection. In this manner, the sea water 9 travelling along fluid flowpaths 148 and 150 through passage 54 of tendon 52 efficiently cools electrical cable 56 through convection.

Figure 6:
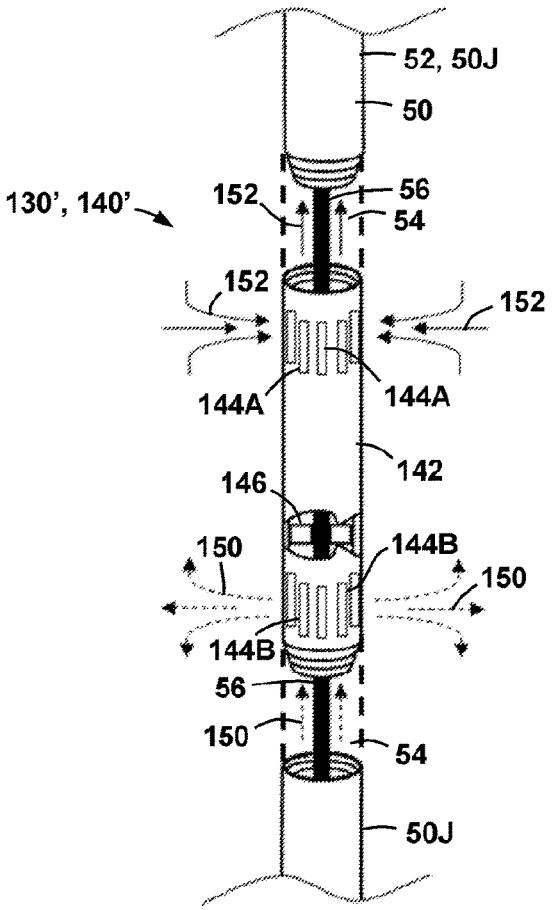
FIG. 6 is a partial schematic side view an embodiment of a cooling system in accordance with principles disclosed herein.

Referring now to FIG. 6, another embodiment of a cooling system 130' including a subsea cooling assembly 140' is shown. In the embodiment of FIG. 6, surface pump 132 previously described pumps sea water upwards along an upper fluid flowpath 152 through passage 54 of tendon 52. Sea water flowing upward along flowpath 152 is ejected from passage 54 via port 55, flows through hose 134, and enters a suction of surface pump 132. In some embodiments, surface pump 132 may discharge the suctioned sea water back into the sea disposed beneath waterline 7. Thus, in this embodiment, surface pump 132 comprises a suction pump configured to suction sea water from passage 54 of tendon 52 whereas, in the embodiment of FIG. 5, surface pump 132 comprises a discharge pump configured to discharge sea water into passage 54 of riser 52.

Figure 7:
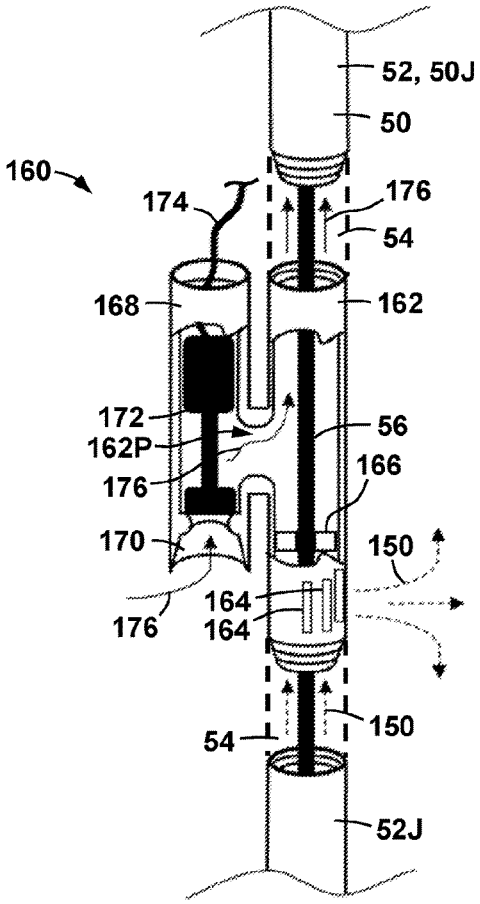
FIG. 7 is a partial schematic side view an embodiment of a cooling system in accordance with principles disclosed herein.

Referring now to FIG. 7, another embodiment of a cooling system 160 for use with the riser system 50 of FIG. 1 is shown. In the embodiment of FIG. 7, cooling system 160 generally includes a tubular cooling joint 162 coupled to adjacent tendon joints 52J of tendon 52, and a tubular pump housing 168 that includes a subsea pump 172 housed therein. In this embodiment, cooling joint 162 includes a plurality of circumferentially spaced ports or vents 164 and an annular collar or seal assembly 166 positioned radially between an outer surface of electrical cable 56 and an inner surface of cooling joint 162. Pump housing 168 has a first or upper end and a second or lower end opposite the upper end, where the lower end of pump housing 168 includes a fluid inlet 170. Fluid communication is provided between pump housing 168 and the cooling joint 162 coupled therewith via a port or passage 162P formed in cooling joint 162. An electrical cable 174 extends between subsea pump 172 and platform 12, and supplies subsea pump 172 with power.

In this embodiment, upward fluid flowpath 150 is provided with cooling system 160 using ports 164 of cooling joint 162 to allow venting of sea water flowing along flowpath 150. Additionally, instead of using a pump disposed on platform 12, subsea pump 172 provides an upper fluid flowpath 176 extending between fluid inlet 170 of pump housing 168 and the upper end 52A of tendon 52. Particularly, sea water enters pump housing 168 via fluid inlet 170, and is pumped into passage 54 of tendon 52 via subsea pump 172 and passage 162P. The sea water flowing along upper fluid flowpath 176 is then pumped via subsea pump 172 upwards through passage 54 towards upper end 52A, where the sea water is ejected from passage 54 via port 55. In this manner, subsea pump 172 may be used to cool electrical cable 56, including the portion of cable 56 extending between waterline 7 and the upper end 52A of tendon 52, via forced convection from sea water flowing along the upward fluid flowpath 176.

Figure 8:
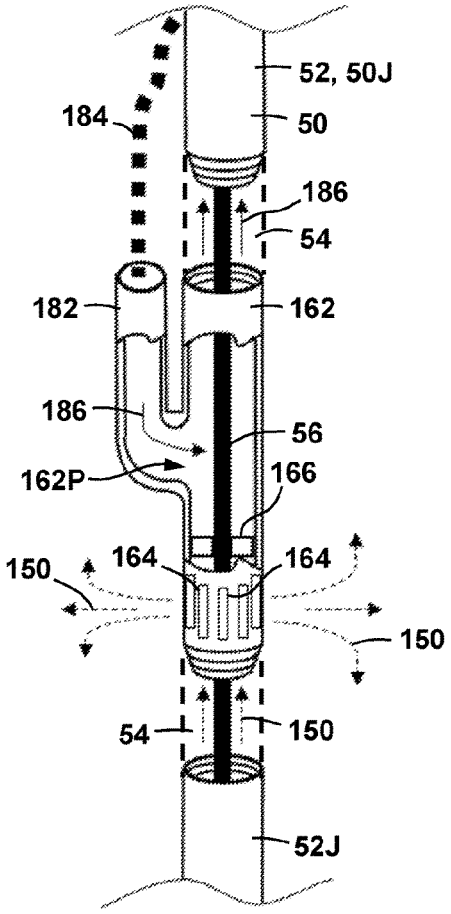
FIG. 8 is a partial schematic side view an embodiment of a cooling system in accordance with principles disclosed herein.

Referring now to FIG. 8, yet another embodiment of a cooling system 180 for use with the riser system 50 of FIG. 1 is shown. In the embodiment of FIG. 8, cooling system 180 generally includes tubular cooling joint 162 and, instead of the pump housing 162 of cooling system 160, a branch conduit 182 coupled therewith. Branch conduit 182 has a first or upper end and a second or lower end opposite the upper end, where the lower end of branch conduit 182 couples with cooling joint 162. Fluid communication is provided between branch conduit 182 and the cooling joint 162 coupled therewith via passage 162P. In this embodiment, a fluid conduit or hose 184 extends between surface pump 132 and the upper end of branch conduit 188. In this arrangement, an upper fluid flowpath 186 is formed that extends through hose 184, branch conduit 182, cooling joint 162, and passage 54 of tendon 52. Particularly, surface pump 132 pumps sea water through hose 184 and along flowpath 186 into branch conduit 182, from branch conduit 182, the sea water 9 is forced upward through passage 54 of tendon 52 due to the blockage provided by collar 166. The sea water is subsequently pumped upward through passage 54 toward upper end 52A of riser 52, and exits passage 54 via port 55. In this manner, cooling system 180 provides an upper fluid flowpath 186 similar to the upper fluid flowpath 176 of cooling system 160 but with surface pump 132, not subsea pump 172, providing the motive force for pumping sea water therealong.

Figure 9:
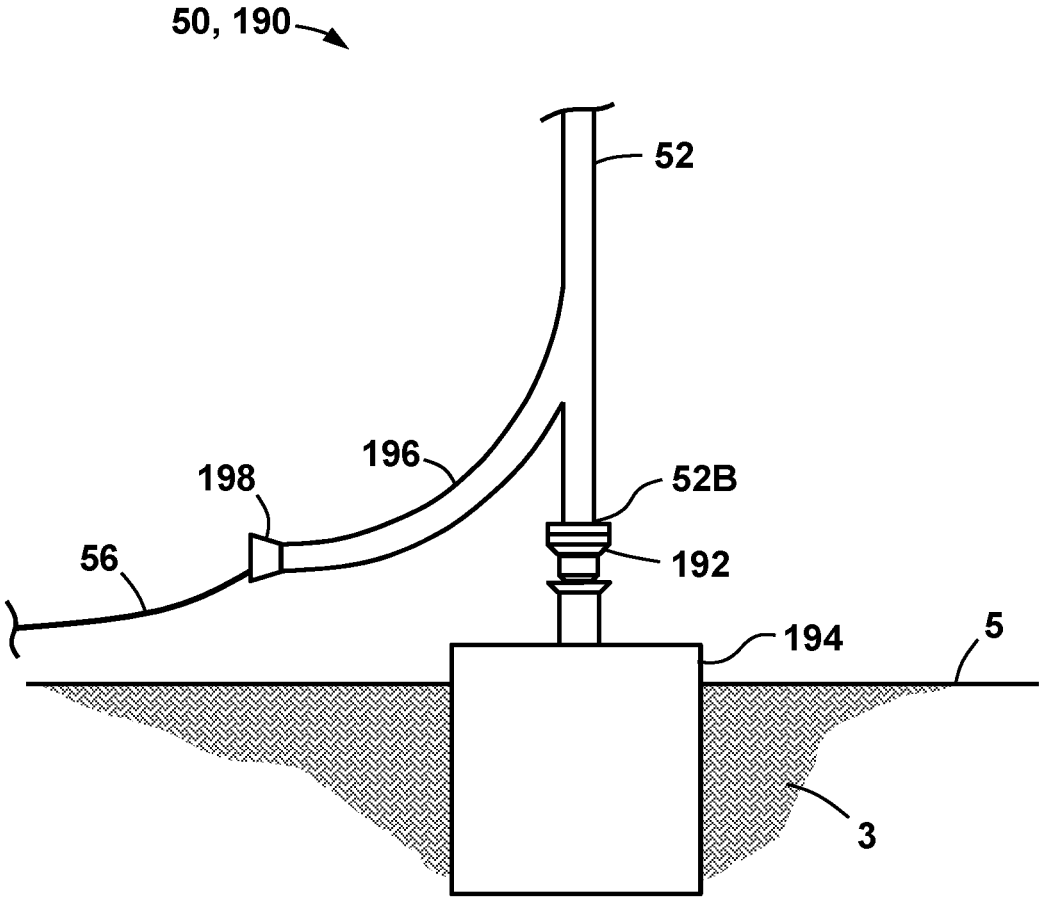
FIG. 9 is an enlarged schematic view of the lower connection system of FIG. 1.

Referring now to FIGS. 1 and 9, lower connection system 190 of the riser system 50 is shown. In the embodiment of FIG. 9, lower connection system 190 generally includes a tendon joint or connector 192, a foundation or support 194, a curved conduit or J-tube 196, and an opening or bell-mouth 198. In this embodiment, tendon joint 192 couples with the lower end 52B of tendon 52 and comprises a flex joint configured to allow relative angular movement or flex relative foundation 194, where tendon joint 192 is affixed or mounted to an upper end of foundation 194. In other embodiments, connector 192 may comprise a stress joint (not shown) that is configured to provide a variable stiffness between foundation 194 and tendon 52. Foundation 194 couples or secures the lower end 52B of tendon 52 to the seabed 5. In this embodiment, foundation 194 comprises a suction can or anchor that extends partially into the seabed 5 and relies on fluid suction or vacuum to affix foundation 194 to the seabed 5; however, in other embodiments, foundation 194 may comprise other mechanisms known in the art for coupling tendon 52 to the seabed 5.

J-tube 196 provides a fixed bend radius to electrical cable 56 as cable 56 extends into the passage 54 of tendon 52 proximal lower end 52B. In this embodiment, bell-mouth 198 is coupled to a terminal end of J-tube 196 and comprises a frustoconical inner surface, with a diameter of the frustoconical surface decreasing moving towards J-tube 196. In some embodiments, bell-mouth 198 may provide a fluid inlet for sea water flowing along upward fluid flowpath 150 shown in FIGS. 5-8. Further, in some embodiments, bell-mouth 198 may provide an inlet for electrical cable 56 when cable 56 is initially installed in production system 10. For instance, electrical cable 56 may be installed via a "pull-in" operation where an upper end of cable 56 is coupled to a cable or flexible line (e.g., a steel wire rope) that is installed through the J-tube 196 and tendon 52. Particularly, the flexible line is extended through tendon 52 and J-tube 196, with a first or upper end of the line disposed at platform 12. Following the installation of the flexible line, an installation vessel (not shown) may attach a lower end of the flexible line to an upper end of electrical cable 56.

With electrical cable 56 attached to the flexible line, the flexible line may be reeled-in to platform 12, thereby transporting the upper end of electrical cable 56 into tendon 52 via bell-mouth 198 and J-tube 196, and from tendon 52 to platform 12 for connection with power plant 20. The frustoconical inner surface of bell-mouth 198 may thereby assist with directing or guiding the upper end of electrical cable 56 into J-tube 196 and tendon 52 during these operations. Additionally, the use of J-tube 196 and bell-mouth 198 eliminates or reduces the need for additional guides for directing and/or supporting electrical cable 56. By extending electrical cable 56 through tendon 52 and physically supporting cable 56 at the upper end 52A of tendon 52 via connector assembly 110, the amount of vertical and lateral motion to which electrical cable 56 is subject to during the operation of production system 10 is reduced, thereby increasing the longevity and reliability of cable 56.

Figure 10:
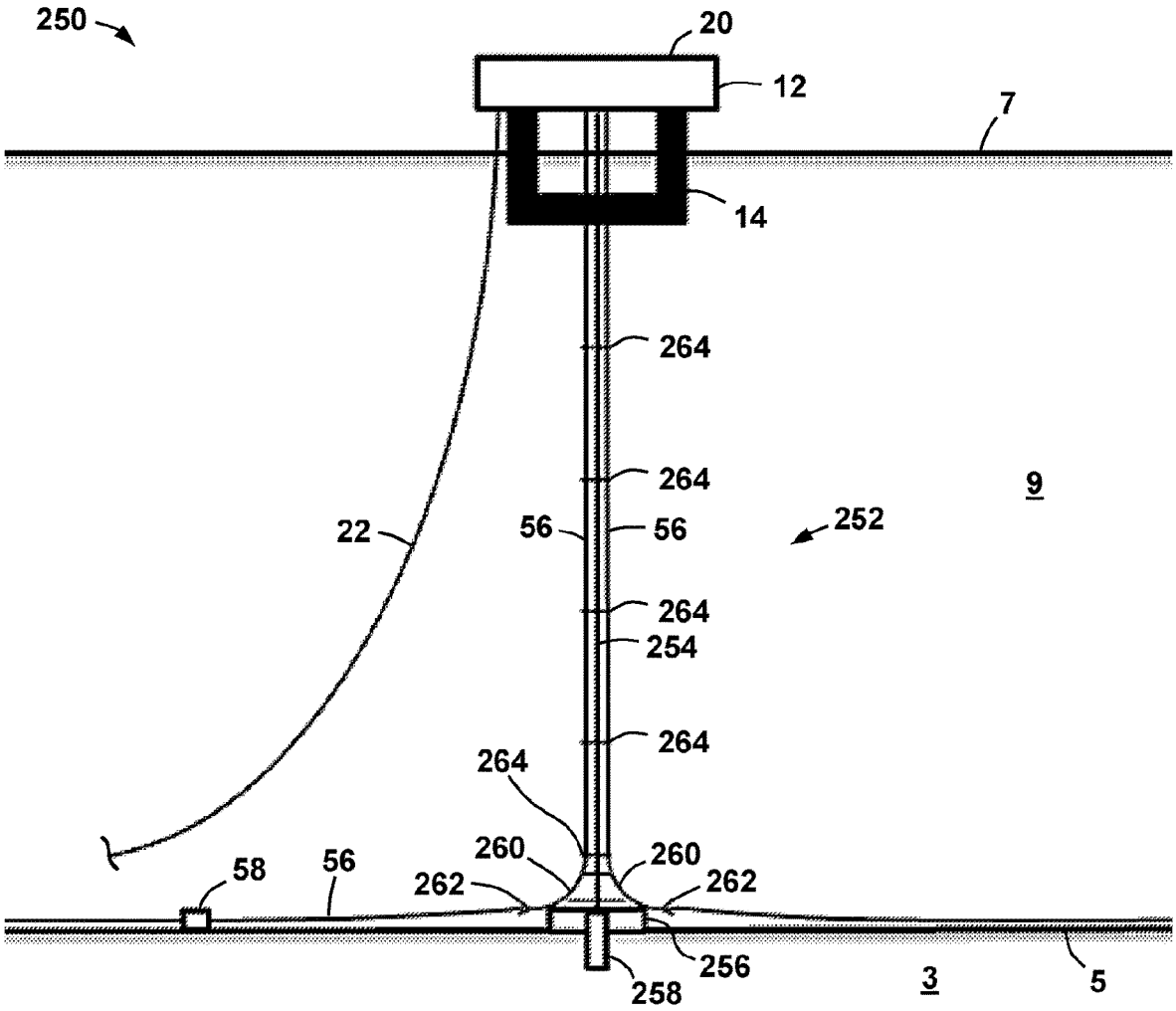
FIG. 10 is a schematic side view of an embodiment of an offshore production system in accordance with principles disclosed herein.

Referring to FIG. 10, another embodiment of a production system 250 including a riser system 252 is shown. Production system 250 and riser system 252 include features in common with production system 10 and riser system 50 of FIG. 1, and shared features are labeled similarly. Unlike the riser system 50 of production system 10 described above, riser system 252 of production system 250 comprises a plurality of electrical cables 56 extending between platform 12 and the seabed 5. Particularly, in the embodiment of FIG. 10, riser system 252 comprises a TTR bundle system 252 that includes a central tendon 254 surrounded by a plurality of circumferentially spaced electric cables 56. Tendon 254 has a first or upper end coupled to platform 12 and a second or lower end coupled to a lower connection system or base disposed at the seabed 5.

In this embodiment, base 256 includes a foundation 258 (e.g., a suction can or anchor) and a plurality of circumferentially spaced J-tubes 260, each J-tube 260 including a bell-mouth 262 coupled to a lower end thereof. Additionally, in this embodiment, riser system 252 includes a plurality of annular guides or hubs 264 spaced along the longitudinal length of tendon 254. In this arrangement, each hub 264 couples with the central tendon 254 and surrounding electrical cables 56, thereby allowing tendon 254 to physically support cables 56. Each electrical cable 56 of riser system 252 extends through a corresponding J-tube 260 and bell-mouth 262 at the seabed 5. In this manner, multiple cables 56 may extend between the platform 12 and seabed 5 while still receiving structural support from tendon 254, thereby reducing the amount of vertical and lateral motion to which electrical cables 56 are subject during the operation of production system 250. In some embodiments, cables 56 may be installed through a pull-in operation where the cables 56 are each coupled to a flexible line and pulled through hubs 264. Additionally, in some embodiments, each cable 56 may be pulled through one or more cooling joints, such as cooling joints 142 and/or 162 described above and shown in FIGS. 7 and 8, respectively. In other words, in some embodiments, hubs 264 may comprise cooling joints, such as cooling joints 142 and/or 162.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3), before steps in a method claim are not intended to and do not specify a particular order to the steps, but rather are used to simplify subsequent reference to such steps.

What is claimed is:

1. An offshore production system, comprising:

a surface vessel;

a tubular tendon extending between the surface vessel and a lower connection system disposed at a seabed, the tubular tendon coupled to the surface vessel with an upper connection system; and an electrical cable extending through a central passage of the tubular tendon;

wherein the upper connection system comprises a connector that physically supports the electrical cable;

a cooling system including a cooling joint disposed subsea along the tubular tendon, wherein the cooling joint comprises a first port configured to vent sea water from central passage and allow cooling of the electrical cable through natural convection.

2. The offshore production system of claim 1, wherein the surface vessel comprises a floating platform.

3. The offshore production system of claim 1, wherein the tubular tendon comprises a top-tension riser.

4. The offshore production system of claim 1, wherein the connector comprises an armor pot connector.

5. The offshore production system of claim 1, wherein the cooling system includes a pump configured to pump fluid through the central passage to cool the electrical cable.

6. The offshore production system of claim 5, wherein the pump is positioned on the surface vessel.

7. The offshore production system of claim 5, wherein the pump is positioned subsea.

8. The offshore production system of claim 1, wherein the cooling joint comprises a second port configured to allow sea water to enter a passage of the cooling joint.

9. An offshore production system, comprising:

a surface vessel;

a tendon having an upper end coupled to the surface vessel and a lower end coupled to a base disposed at a seabed;

an electrical cable extending between the surface vessel and the base;

a hub spaced from the base and coupled to the tendon and the electrical cable; and a J-tube coupled to the base, wherein the electrical cable extends through the J-tube, wherein the tendon is spaced from the J-tube and disposed outside the J-tube;

wherein the hub is positioned along the tendon between the surface vessel and the base, and wherein the hub is configured to transfer a load of the electrical cable to the tendon such that the tendon supports the load of the electrical cable.

10. The offshore production system of claim 1, wherein the cooling joint comprises a second port positioned above the first port and a seal assembly positioned within the cooling joint between the first port and the second port, wherein the sealing assembly is configured to prevent the flow of fluid through the central passage of the tubular tendon between a first portion of the central passage below the seal assembly and a second portion of the central passage above the seal assembly.

11. The offshore production system of claim 9, further comprising a plurality of electrical cables circumferentially spaced about the tendon, wherein each electrical cable is coupled to the hub and extends through a J-tube coupled to the base.

12. The offshore production system of claim 9, further comprising:

a hydrocarbon conduit extending to the surface vessel; and a power plant disposed on the surface vessel, wherein the power plant is configured to convert chemical energy provided by hydrocarbons supplied by the hydrocarbon conduit into electrical energy transportable by the electrical cable.

13. The offshore production system of claim 9, further comprising a bell-mouth coupled to an end of the J-tube.

14. The offshore production system of claim 9, wherein the hub comprises a cooling joint that includes a first port configured to allow sea water to enter a passage of the cooling joint and a second port spaced from the first port configured to vent sea water from the passage and cool at least one of the electrical cables through natural convection.

15. The offshore production system of claim 14, further comprising a pump configured to pump sea water through the passage of the cooling joint to cool at least one of the electrical cables through forced convection.

16. An offshore production system, comprising:

a surface vessel;

a tubular tendon extending between the surface vessel and a lower connection system disposed at a seabed, the tubular tendon coupled to the surface vessel with an upper connection system; and an electrical cable extending through a central passage of the tubular tendon;

wherein the upper connection system comprises a connector housing coupled to an upper end of the tubular tendon, wherein the connector housing receives the electrical cable therethrough, and wherein the connector housing is filled with a potting material that is configured to transfer loads between the electrical cable and the connector housing;

a cooling system including a cooling passage extending helically about the electrical cable within the connector housing, wherein the cooling system further includes a pump configured to flow a cooling fluid through the cooling passage.

17. The offshore production system of claim 16, wherein the potting material comprises a resin that is configured to form a resin matrix.

18. The offshore production system of claim 17, wherein the upper connection system further comprises a top tensioner including a plurality of tensioner links coupled to the tubular tendon and the surface vessel, wherein each tensioner link includes a tensioner that is configured to controllably adjust a tension in in the tensioner link.

19. The offshore production system of claim 18, wherein the lower connection system includes:

a foundation extending into the seabed, wherein the foundation is coupled to a lower end of the tubular tendon;

a J-tube coupled to and extending from the tubular tendon; and a bell-mouth coupled to an end of the J-tube;

wherein the electrical cable extends from the tubular tendon and through the J-tube.

20. The offshore production system of claim 18, wherein the lower end of the tubular tendon is coupled to the foundation with a flex joint that is configured to allow relative angular movement between the foundation and the tubular tendon.

* * * * *